US008672274B2

(12) United States Patent
Albisua Aspiazu

(10) Patent No.: US 8,672,274 B2
(45) Date of Patent: Mar. 18, 2014

(54) LOCKING DEVICE FOR CROSSINGS WITH MOVABLE FROG POINT

(71) Applicant: Amurrio Ferrocarril y Equipos, S.A, Amurrio (ES)

(72) Inventor: Vicente Albisua Aspiazu, Ammurio (ES)

(73) Assignee: Amurrio Ferrocarrily y Equipos, S.A., Amurrio (Alava) (ES)

( * ) Notice: Subject to any disclaimer, the term of this patent is extended or adjusted under 35 U.S.C. 154(b) by 0 days.

(21) Appl. No.: 13/647,467

(22) Filed: Oct. 9, 2012

(65) Prior Publication Data

US 2013/0032675 A1 Feb. 7, 2013

Related U.S. Application Data

(63) Continuation of application No. PCT/ES2011/070221, filed on Mar. 31, 2011.

(30) Foreign Application Priority Data

Apr. 9, 2010 (ES) ..... 201030321

(51) Int. Cl.
*E01B 7/10* (2006.01)

(52) U.S. Cl.
USPC ..... 246/468; 246/448

(58) Field of Classification Search
USPC ..... 246/448, 449, 450, 454, 468, 469, 470, 246/471, 458
See application file for complete search history.

(56) References Cited

U.S. PATENT DOCUMENTS

| | | | | | |
|---|---|---|---|---|---|
| 3,723,728 | A | * | 3/1973 | von Hayn | 246/468 |
| 4,624,428 | A | * | 11/1986 | Frank | 246/276 |
| 4,953,814 | A | * | 9/1990 | Oswald et al. | 246/382 |
| 4,982,919 | A | * | 1/1991 | Durchschlag et al. | 246/382 |
| 5,730,395 | A | * | 3/1998 | Carmes | 246/448 |
| 5,782,437 | A | * | 7/1998 | Irie et al. | 246/276 |

(Continued)

FOREIGN PATENT DOCUMENTS

| | | | | |
|---|---|---|---|---|
| EP | 2154047 | A1 * | 2/2010 | B61L 5/10 |
| ES | 2 159 705 | | 10/2001 | |
| FR | 2 847 916 | | 6/2004 | |
| WO | 2008/142182 | | 11/2008 | |

OTHER PUBLICATIONS

International Search Report issued Aug. 19, 2011 in International (PCT) Application No. PCT/ES2011/070221.

*Primary Examiner* — Jason C Smith
(74) *Attorney, Agent, or Firm* — Wenderoth, Lind & Ponack, L.L.P.

(57) ABSTRACT

Locking device for crossings with movable frog point, including a cradle support with a central recess into which a movable frog point with transverse displacement in order to place thereof in two steady end positions is housed; characterized in that it comprises a pair of side left (10) and right (11) boxes, a transverse slide (9) through central part of which is connected to a movable frog point (8) being coupled in said side boxes (10-11), a widger (14) axial displacement of which carries the transverse slide (9) being guided inside said transverse slide (9), the widger (14) further comprising some depressions (30) into which the bottom of the locking rollers (25) is housed during the relative displacement of the widger (14) with respect to the transverse slide (9) and also during the whole movement of both elements (9-14).

5 Claims, 5 Drawing Sheets

(56) References Cited

U.S. PATENT DOCUMENTS

| | | | | |
|---|---|---|---|---|
| 6,138,958 | A * | 10/2000 | Irie et al. | 246/276 |
| 6,543,728 | B1 * | 4/2003 | Benenowski et al. | 246/472 |
| 7,309,050 | B2 * | 12/2007 | Heinze et al. | 246/460 |
| 8,424,812 | B1 * | 4/2013 | Voelkerding et al. | 246/468 |
| 8,424,813 | B1 * | 4/2013 | Voelkerding et al. | 246/468 |
| 2004/0065784 | A1 * | 4/2004 | Hein | 246/468 |
| 2004/0069911 | A1 * | 4/2004 | Schnedl | 246/448 |
| 2011/0011986 | A1 * | 1/2011 | Ossberger et al. | 246/468 |
| 2013/0032675 | A1 * | 2/2013 | Albisua Aspiazu | 246/468 |

* cited by examiner

LOCKING DEVICE FOR CROSSINGS WITH MOVABLE FROG POINT

OBJECT OF THE INVENTION

The present invention, as this specification states in its title, relates to a locking device for crossings with movable frog points. The crossings have movable frog points through which the diamond gap or empty space existing between the frogs of railroads is eliminated, thus ensuring the passage of trains without noises and rattling, so that the movable frog point moves transversely in order to achieve two steady end positions on the basis of the railroad along which the train passes.

Thus, the object of the invention is a device for blocking and locking the crossing with movable frog points of a tramway crossing with movable frog points, structure and design of which make it easy to install with practically no maintenance.

BACKGROUND OF THE INVENTION

The turnout is an apparatus that allows the separation of one railroad into two or more, axes of which tangentially meet with the one of the first or form a very small angle therewith.

The simplest case of a turnout is called single or double turnout, which leads to running for taking a way or the other. The main one receives the name of direct railroad and the other one of diverged railroad.

The separation and crossing of both railroad threads are caused by using two elements: the point with tongues and the crossing, which together with the connecting rails between them forms the three main parts of the apparatus:

- The point, which consists of two tongue-over-tongue assemblies (semi-points), allowing the splitting of the running threads.
- The intermediate or connecting rails, which connect the point to the frog.
- The very crossing, which comprises the intercept of the right (left) rail of the direct railroad with the left (right) rail of the diverged railroad.

The crossing is the part wherein two rails intersect, on the one hand the direct railroad and on the other the diverged railroad.

In order to allow the passage of wheel flanges a discontinuity is inserted into both rails which empty space, is so-called diamond gap.

The extension existing in the rails for allowing the support of the wheel rolling on the outer edge of the rim when the tongue passes through the diamond gap is so-called wing rails. Such crossings are so-called crossings with fixed frog points.

In the transit of vehicle axles through the crossing the wheel shock can be caused on crossing areas. These shocks reduce the life time of both the very turnout and the movable material moving thereon, leading to noises and violent movements affecting the comfort of the passengers.

The bumps have two major consequences:

- Produce noises that annoy the neighbors if they are urban roads.
- Produce bumps, that annoy the passengers and also produce wears in the very crossing and in the train wheels too.

In order to ensure the safe passage of vehicles through the crossing (without noises or bumps), it is necessary to eliminate diamond gaps. For removing thereof, the crossing with movable frog points is developed.

In these apparatuses, the frog point is mobile and moves from one position to another, depending from where the train comes, thus eliminating the diamond gaps.

As the frog point is a movable rail, a mechanical drive that makes it moves is needed. Locks are used to ensure that once moved, it will be maintained in that position withstanding the running passes.

This premise is very important because if the frog point is moved, the running pass of the trains would cause their derailment.

DESCRIPTION OF THE INVENTION

A common crossing with movable frog points in principle comprises a cradle support positioned in an empty space corresponding to a diamond gap that interrupts the continuity of two intercepting rails of two different railroads, that cradle support including a central recess wherein the movable frog point associated with one some transverse displacement means is located, in order to reach each of the two steady end positions of the movable frog point depending on the selected railroad.

In turn, the cradle support includes two pairs of end rail sections that follow the interrupted intercepting rails of two different railroads, so that such end rail sections of the cradle support are interrupted in the central area corresponding to the central recess into which the movable frog point with transverse displacement is located.

Starting from this premise, the locking device for crossings with movable frog points is characterized by including a locking body comprising a left side box and another right side box, both fixed at the bottom to the support cradle, a transverse slide with tubular structure being connected with both boxes, inside of which a widger is in turn coupled, axial displacements of which carries the transverse slide and the latter to the movable frog points in order to steadily place it in one of its two steady end positions according to the selected railroad along which the train must travel.

The transverse slide includes a central body wherein the movable frog point is connected through a support having a longitudinal roller to which two jaws are clamped, which in turn are fixed to the soul of the movable frog point.

In turn, the transverse slide comprises some upper hollows into which two separate vertical displacement locking rollers facing some skids housed in some recesses of both lateral boxes are housed, which recesses are arranged above the transverse slide, so that these skids are coupled in the threads of blockage take up screws associated with side boxes, so that the rotation of such blockage take up screws carries the skids in order to place them in the more suitable position.

The bottom faces of the mentioned skids are in contact with the respective locking rollers, said lower faces including curved recesses complementary to the curvature of such locking rollers.

On the other hand, the widger comprises depressions corresponding to the locking rollers, having such depressions a length longer than the diameter of the mentioned locking rollers, so that these can be housed through their bottom into the depressions, either simultaneously or one roller can be housed and the other does not.

The simultaneous fit of the two locking rollers into the respective depressions of the widger coincides with an intermediate step of the widger displacement when moving from one steady end position of the movable frog point to the other.

In contrast, in the steady end positions of the movable frog point, the locking roller corresponding to the rail of the selected railroad is fitted through its top into the curved recess on that same side of the rail securing the immobilization of the stable position of the movable frog point because of the locking roller is simultaneously set in such curved recess and into the upper hollow of the transverse slide that is currently blocked due to the static position of the widger.

In contrast, the other paired locking roller is completely hidden into the upper hollow of the transverse slide and also housed in the other paired depression of the widger.

Moreover, the advantages of the locking device for crossings of the invention are, among others, the following:

Almost zero maintenance.

Easy to install and uninstall.

Can be installed in a hollow sleeper.

Compact, leaving free space on the hollow sleeper.

Effective tightening between the movable frog point and the cradle support. This tightening is not altered by expansions of the movable frog point and batting, and can be further regulated from outside.

Next, to facilitate a better understanding of this specification and being an integral part thereof, some figures wherein the object of the invention has being represented in an illustrative and not limitative manner are attached.

PREFERRED EMBODIMENT OF THE INVENTION

Figure 1:
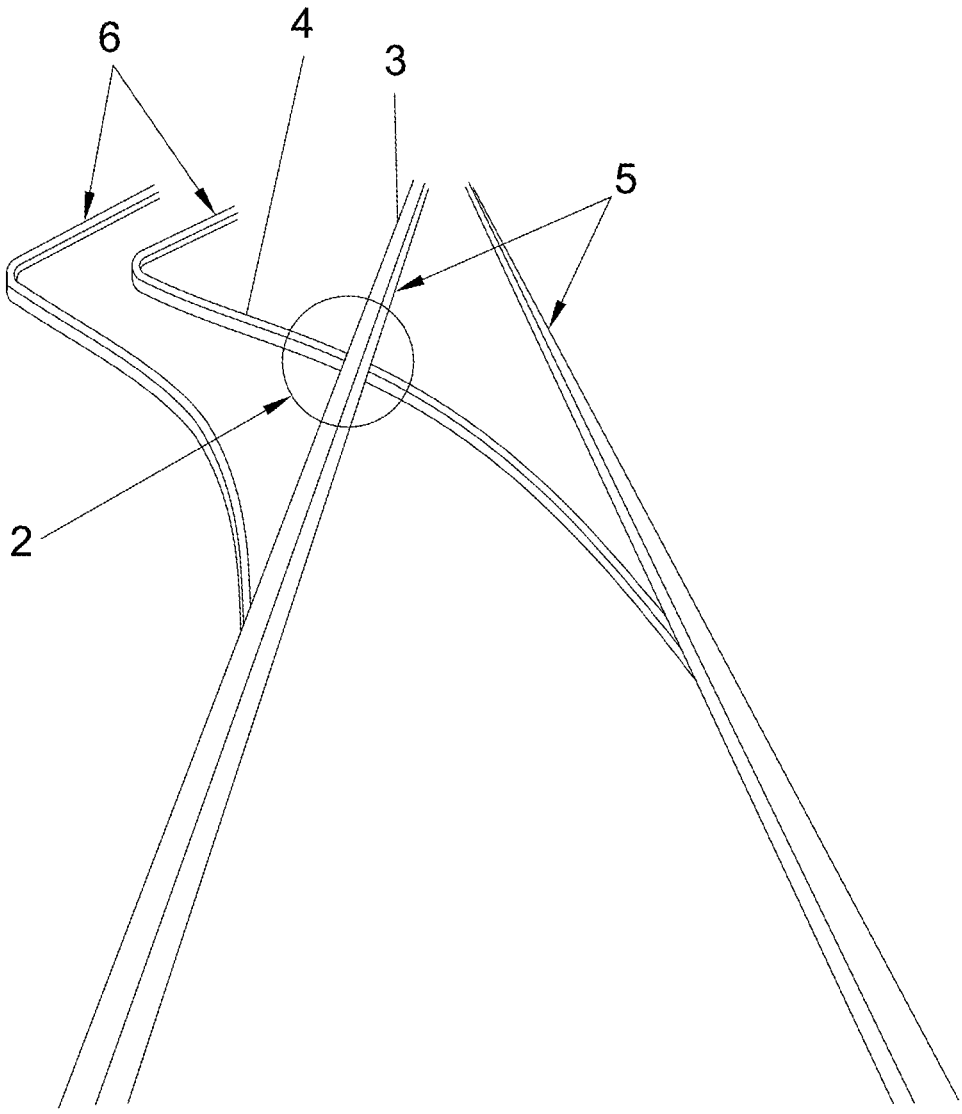
FIG. 1.—Shows a schematic view of the unfolding of a two-track railroad that includes a point and a common crossing device with movable frog points. The common crossing device basically comprises a cradle support, a movable frog point with transverse displacement located into the central recess of the cradle support. The movable frog point can adopt two steady end positions depending upon the selected railroad.

Considering the numbering adopted in the figures, the common crossing device with movable frog points includes a cradle support 1 fixed in correspondence with the interruption of a crossing 2 of two rails 3-4 belonging to two different railroads 5-6, said cradle support 1 having a central recess 7 into which a movable frog point 8 associated with a transverse slide 9 of tubular structure guided in some lateral boxes: left 10 and right 11 is housed, both making up a lock body attached at the bottom to the cradle support 1 by using vertical screws 12 and nuts 13.

Within the transverse slide 9 a widger 14 with a small relative axial movement with respect to said transverse slide 9 is attached, while the axial displacement of such widger 14 carrying the transverse slide 9 and the latter the movable frog point 8 in order to steady place it in one of the two possible end side positions according to the rails of the cradle support 1 aligned with the rails 3-4 of one or other selected railroad 5-6 along which the train must transit.

The transverse slide 9 includes a central body 15 wherein a support 16 comprising a longitudinal roller 17 is attached, to which two jaws: left 18 and right 19 are resiliently clamped through their bottom, by means of some resilient washers 20 with conical configuration pressed against the longitudinal roller 17 with the interposition of some intermediate pieces 21 contacting against that longitudinal roller 17.

In turn, the pair of jaws 18-19 is fixed though their top to the soul of the movable frog point 8 by means of some horizontal screws 22 and nuts 23, highlighting that said jaws 18-19 are adapted to the profile of both sides of the movable frog point 8.

During the transverse displacement of the movable frog point 8, the force is shifted through the use of the longitudinal roller 17 parallel to the axis of the movable frog point 8, so that the longitudinal roller 17 pushes the left jaw 18 for moving the movable frog point 8 to the left, and the jaw 19 for moving the movable frog point 8 to the right.

The use of the longitudinal roller 17 allows maintaining the tightening without friction or wear, although the movable frog point 8 tends to be displaced because of the expansions or tends to be lowered to the pass of trains, emphasizing that the shifting of forces to the longitudinal roller 17 is elastic because of the use of resilient washers 20 placed in series in some boxes of such jaw 18-19. The conical structure of the resilient washers 20 provides an elastic force proportional to the strain to which they are subjected in the same axial direction.

The use of the resilient washers 20 provides the advantage of allowing being able of maintaining a strong pressure between the movable frog point 8 and the cradle support 1.

The assembly of said resilient washers 20 with a series of springs arranged between them is packaged and protected by using some seals against the dirt entry.

On the other hand, the transverse slide 9 includes upper hollows 24 wherein two separate locking rollers 25 with free vertical displacement are housed, and faced with a some skids 26 housed in some recesses 27 of both side boxes 10-11 arranged above the transverse slide 9, so that these skids 26 are coupled in the thread of some blockage take up screws 28 associated with the boxes 10-11, so that the rotation of such blockage take up screws 28 carries the skids 26 in order to place them in the more suitable position.

For providing more or less torque to the movable frog point 8 on the cradle support 1, the blockage take up screws 28 are rotated. These are threaded into the skids 26 such as stated earlier, thereby when said blockage screws are rotated, the position of the skids is displaced in relation to their side boxes 10 and 11.

By this action the movable frog point 8 is approached to the cradle support (giving more tightening if coupled) or distanced from the cradle support (tightening is taken away if it was coupled). To facilitate the rotation with strong pressure between the movable frog point 8 and the cradle support 1 some internal anti-friction bearings have been provided.

The lower faces of the skids 26 are in contact with the respective locking rollers 25, said lower faces including curved recesses 29 complementary to the curvature of such locking rollers 25.

Moreover, the widger 14 comprises depressions 30 corresponding to the locking rollers 25, such depressions 30 having a length longer than the diameter of the locking roller 25, so that these can be housed through their bottom into the mentioned depressions 30, either simultaneously or a roller can be housed and the other does not. The depressions 30 include end curved edges consistent with the curvature of the locking rollers 25.

The simultaneous fit of the two locking rollers 25 into the respective depressions 30 of widger 14 coincides with an intermediate step of displacement of the widger 14 when moving from one end position of the movable frog point 8 to the other.

In contrast, in the steady end positions of the movable frog point 8, the locking roller 25 corresponding to the rail of the selected railroad is embedded through its top into the curved recess 29 of that same side of the rail, securing the immobilization of the steady end position selected from the movable frog point 8 because of the aforementioned locking roller 25 is simultaneously set in such curved recess 29 and in the upper hollow 24 of the transverse slide 9 which in this moment is blocked because of the static position of widger 14.

In contrast, the other paired locking roller 25 is completely hidden into the upper hollow 24 of the transverse slide 9, and also housed into the other depression 30 of the widger 14.

Figure 2:
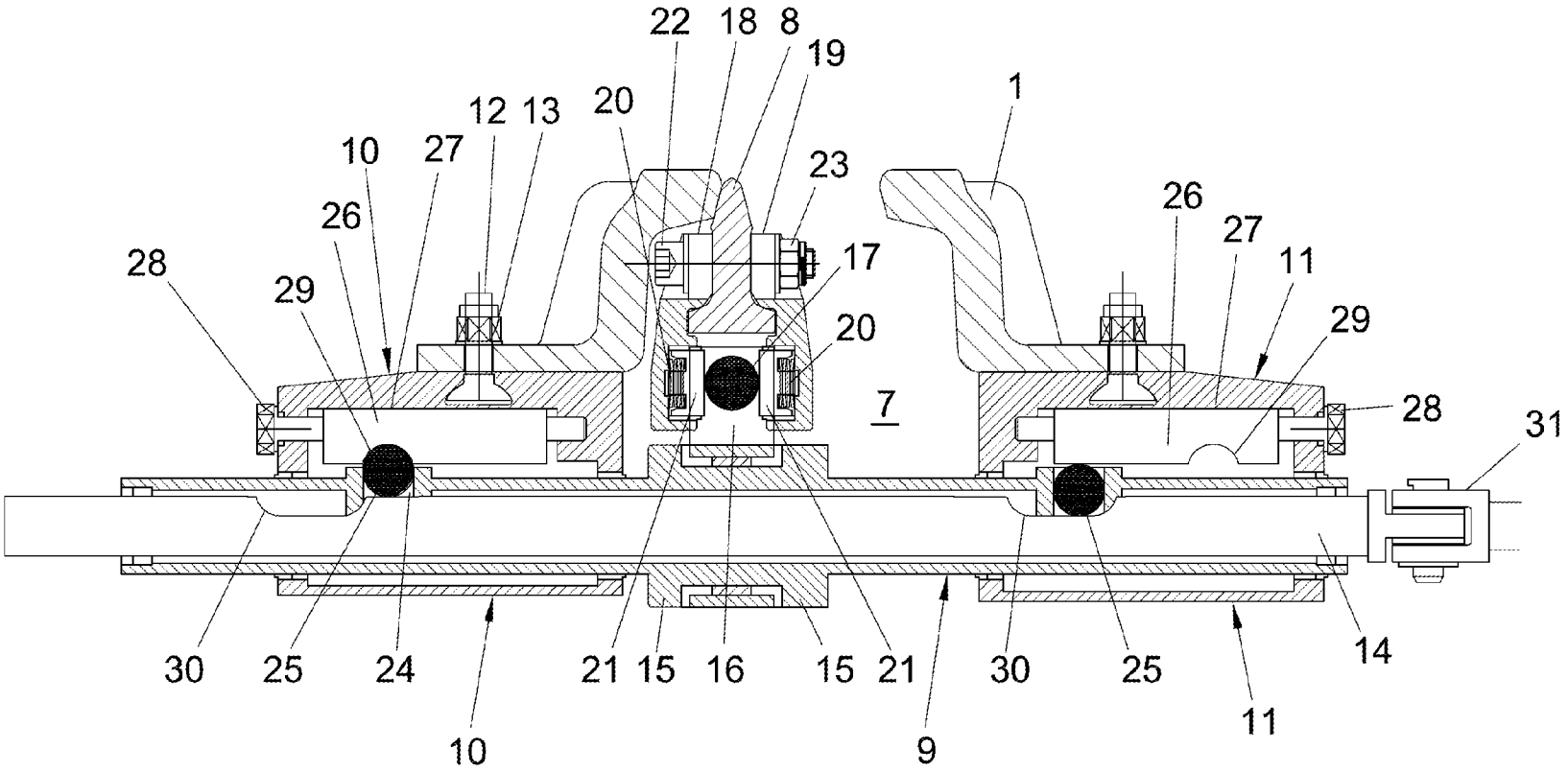
FIG. 2.—Shows a sectional view of the common crossing device wherein the movable frog point is arranged in one of its two steady end positions corresponding to the left side.

With this described arrangement, the functioning of the common crossing device the next starting from the steady position shown in FIG. 2.

The right side box 11 and the left one 10 are each attached to the cradle support 1 by using two vertical screws 12 that joins them to respective lugs being in the cradle support 1 fused to such effect.

The widger 14 movable by means of a side brace 31 is arranged in an end position preventing the displacement from the locking roller 25 of the left side box 10. This locking roller 25 is embedded into the respective curved recess 29 of the skid 26 of the left side box 10 and cannot be unlocked, because it cannot be lowered because is not faced with the respective depression 30 of widger 14.

In this situation, said locking roller 25 mechanically joins the movable frog point 8 to the left side box 10, so that the movable frog point 8 is blocked in the left position. To produce the translation of the movable frog point 8, the widger 14 is displaced by the side brace 31 of an external drive. When the widger 14 is displaced, the locking roller 25 of the left side uncouples from the skid 26 of that same side when falling within the respective depression 30 existing in the widger 14.

Figure 4:
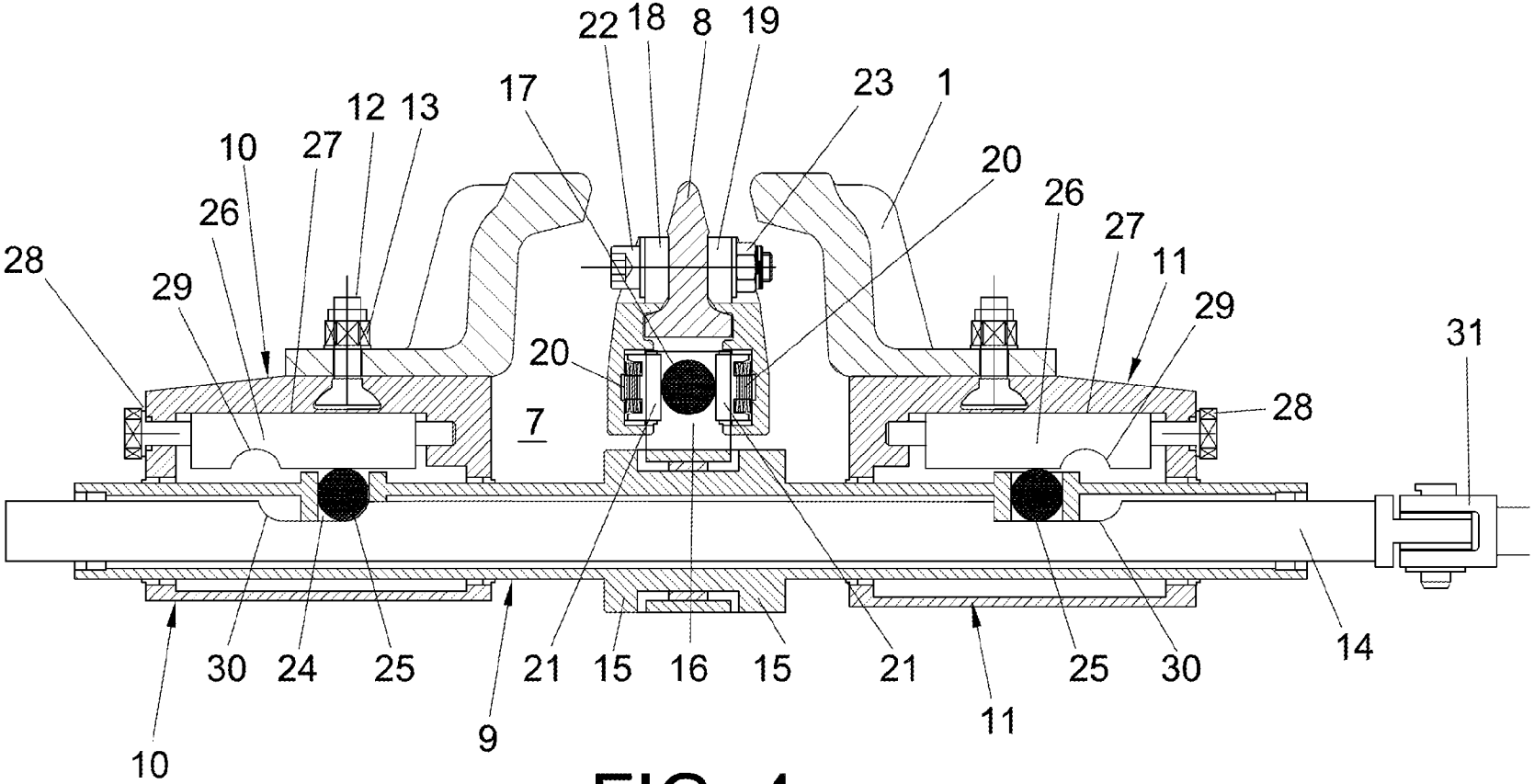
FIG. 4.—Shows a sectional view of the common crossing device wherein it is highlighted that the movable frog point is arranged in an intermediate position in a transit step from one steady end position to another.
Figure 5:
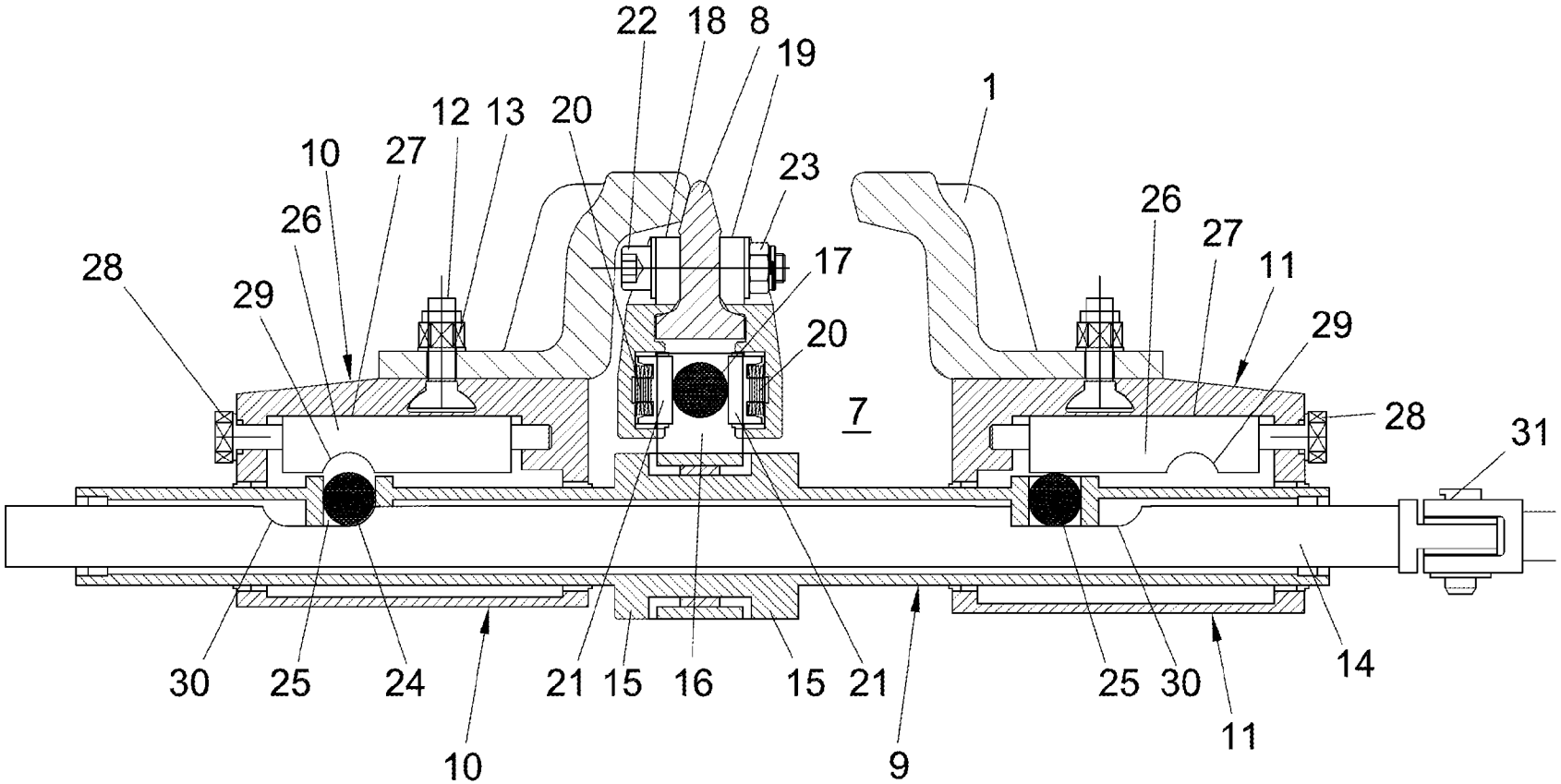
FIG. 5.—Shows another sectional view the common crossing device.

This locking roller 25 no longer performs the blocking and now is carried below the skids 26. By continuing the displacement of the widger 14, this pushes the locking roller 25 on the right side. This locking roller 25 tries to escape upwards, but it cannot, since the skid 26 of that right side prevents it. Therefore, the transverse slide 9 is carried and thus the movable frog point 8 (FIG. 4).

Figure 3:
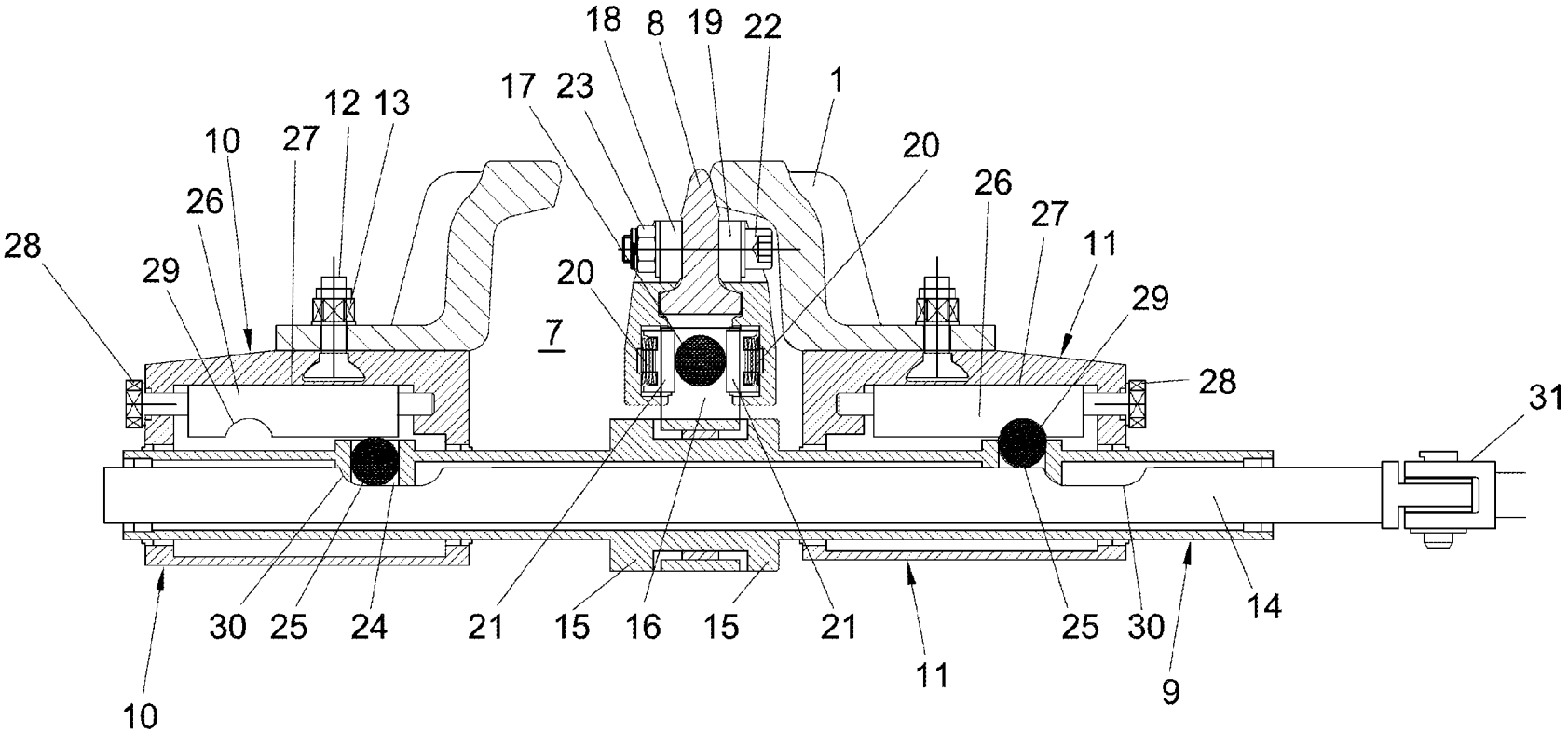
FIG. 3.—Shows a sectional view similar to the previous one wherein the movable frog point arranged in the other steady end position corresponding to the right side is highlighted.

The widger 14 is displaced until the locking roller 25 of the right side meets the respective curved recess 29 of the skid 26 occupying it and allowing the widger 14 to pass underneath. In this situation, the movable frog point 8 returns to be blocked again, this time in the right position (FIG. 3). If the movable frog point 8 moves because of expansions, the jaws 18-19 carries the longitudinal roller 17, and this causes in turn the rotation of the support 16 joining it to the transverse slide 9. All mechanisms are sealed against water and dirt entry.

The invention claimed is:

1. A locking device for crossings with movable frog points, comprising:

a cradle support, said cradle support including a central recess into which a movable frog point with transverse displacement is housed to place the movable frog point in two steady end positions;

a left box and a right box, said left box and said right box being fixed to the cradle support;

a transverse slide coupled into said left box and said right box;

a movable frog point connected through a central part of said transverse slide, a widger guided inside of said transverse slide such that axial displacement of said widger carries the transverse slide;

wherein the transverse slide has an upper hollow into which locking rollers with free vertical displacement are housed;

wherein skids are housed in recesses formed in the right and left boxes, and lower faces of said skids are provided with curved recesses, tops of the locking rollers being separately housed in said curved recesses at the steady end positions of the movable frog point;

wherein the widger further includes depressions in which bottoms of the locking rollers are housed during relative displacement of the widger with respect to the transverse slide and also during joint movement of the widger and the transverse slide; and wherein the skids are coupled with blockage take up screws to adjust positions of the skids, in such a manner that rotation of the take up screws, respectively, carries the skids in one direction or another to fine-tune the movable frog point in the two steady end positions.

2. A locking device for crossings with movable frog points, according to claim 1, wherein the movable frog point is fixed to a central body of the transverse slide by a support that includes a longitudinal roller to which bottoms of left and right jaws are resiliently clamped, while tops of the left and right jaws are fixed to a soul of the movable frog point by horizontal screws and nuts, the profile of both sides of the movable frog point being adapted to said right and left jaws.

3. A locking device for crossings with movable frog points, comprising:

a cradle support, said cradle support including a central recess into which a movable frog point with transverse displacement is housed to place the movable frog point in two steady end positions;

a left box and a right box, said left box and said right box being fixed to the cradle support;

a transverse slide coupled into said left box and said right box;

a movable frog point connected through a central part of said transverse slide, a widger guided inside of said transverse slide such that axial displacement of said widger carries the transverse slide;

wherein the transverse slide has an upper hollow into which locking rollers with free vertical displacement are housed;

wherein skids are housed in recesses formed in the right and left boxes, and lower faces of said skids are provided with curved recesses, tops of the locking rollers being separately housed in said curved recesses at the steady end positions of the movable frog point;

wherein the widger further includes depressions in which bottoms of the locking rollers are housed during relative displacement of the widger with respect to the transverse slide and also during joint movement of the widger and the transverse slide; and wherein the movable frog point is fixed to a central body of the transverse slide by a support that includes a longitudinal roller to which bottoms of left and right jaws are resiliently clamped, while tops of the left and right jaws are fixed to a soul of the movable frog point by horizontal screws and nuts, the profile of both sides of the movable frog point being adapted to said right and left jaws.

4. A locking device for crossings with movable frog points, according to claim 3, wherein a resilient connection between the right and left jaws and the longitudinal roller comprises resilient washers of conical structure and intermediate pieces between the washers and the longitudinal roller.

5. A locking device for crossings with movable frog points, according to claim 3, wherein a resilient connection between the right and left jaws and the longitudinal roller comprises resilient washers of conical structure and intermediate pieces between the washers and the longitudinal roller.

* * * * *